US009102432B2

(12) United States Patent
Muse

(10) Patent No.: US 9,102,432 B2
(45) Date of Patent: Aug. 11, 2015

(54) BAG STAND

(71) Applicant: Pratt Industries, Inc., Conyers, GA (US)

(72) Inventor: John Richard Muse, Douglasville, GA (US)

(73) Assignee: Pratt Industries, Inc., Conyers, GA (US)

( * ) Notice: Subject to any disclaimer, the term of this patent is extended or adjusted under 35 U.S.C. 154(b) by 0 days.

(21) Appl. No.: 14/447,058

(22) Filed: Jul. 30, 2014

(65) Prior Publication Data

US 2014/0331616 A1 Nov. 13, 2014

Related U.S. Application Data

(62) Division of application No. 13/164,464, filed on Jun. 20, 2011, now Pat. No. 8,840,072.

(60) Provisional application No. 61/357,526, filed on Jun. 22, 2010.

(51) Int. Cl.

| | |
|---|---|
| ***A63B 55/04*** | (2006.01) |
| ***B65B 67/12*** | (2006.01) |
| ***B65D 5/04*** | (2006.01) |
| ***B31D 5/00*** | (2006.01) |
| ***B65D 5/02*** | (2006.01) |

(52) U.S. Cl.

CPC ..... *B65B 67/1205* (2013.01); *B31D 5/0086* (2013.01); *B65B 67/1238* (2013.01); *B65D 5/029* (2013.01); *B65D 5/04* (2013.01)

(58) Field of Classification Search

CPC .. B65B 67/1205; B65B 67/1238; B65D 5/04; B65D 5/029; B31D 5/0086

See application file for complete search history.

(56) References Cited

U.S. PATENT DOCUMENTS

| | | | |
|---|---|---|---|
| 474,382 | A | 5/1892 | Haines |
| 645,544 | A | 3/1900 | Bissell |
| 672,657 | A | 4/1901 | Vautrot |
| 1,088,633 | A | 2/1914 | Simmons |
| 1,234,057 | A | 7/1917 | McIntyre |
| 1,571,608 | A | 2/1926 | Stillman |
| 1,858,793 | A | 5/1932 | Archibald |
| 1,879,410 | A | 9/1932 | Morris et al. |
| 1,879,950 | A | 9/1932 | Read, Jr. |
| 2,430,155 | A | 11/1947 | Buttery |
| 2,550,959 | A | 5/1951 | Bowman |

(Continued)

OTHER PUBLICATIONS

Muse, John Richard; Advisory Action for U.S. Appl. No. 13/551,575, filed Jul. 17, 2012, mailed Dec. 4, 2014, 3 pgs.

(Continued)

*Primary Examiner* — Amy Sterling
(74) *Attorney, Agent, or Firm* — Taylor English Duma LLP

(57) ABSTRACT

Disclosed is a bag stand including at least three side panels, each side panel having a top end, a bottom end, a left end, a right end, an inner surface, and an outer surface, each side panel having two adjacent side panels, each right end of each side panel connected to the left end of one of the adjacent side panels and each left end of each side panel connected to the right end of the other adjacent side panel, thereby forming a substantially continuous bag stand having a top end and a bottom end and a plurality of panel tabs, each panel tab hingedly connected to the top end of the bag stand, each panel tab having at least one interfacing end for connection to at least one other of the plurality of panel tabs.

20 Claims, 7 Drawing Sheets

(56) References Cited

U.S. PATENT DOCUMENTS

| | | | |
|---|---|---|---|
| 2,939,614 | A | 6/1960 | Hill |
| 3,257,068 | A | 6/1966 | Wright |
| 3,324,906 | A | 6/1967 | Chu |
| 3,335,769 | A | 8/1967 | Ilg |
| 3,734,340 | A | 5/1973 | Ippolito et al. |
| 3,746,240 | A | 7/1973 | Flynn |
| 3,891,136 | A | 6/1975 | Woeste |
| 3,938,731 | A | 2/1976 | Ross et al. |
| 3,977,594 | A | 8/1976 | Swan |
| 3,983,914 | A | 10/1976 | Benson |
| 4,037,778 | A | 7/1977 | Boyle |
| 4,115,909 | A | 9/1978 | Corella |
| 4,139,029 | A | 2/1979 | Geraci |
| 4,258,842 | A | 3/1981 | Falkstein |
| 4,268,081 | A | 5/1981 | Hawkinson |
| 4,273,167 | A | 6/1981 | Stillwell |
| 4,338,979 | A | 7/1982 | Dow |
| 4,361,267 | A | 11/1982 | Wozniacki |
| 4,366,916 | A | 1/1983 | Guido et al. |
| 4,457,483 | A | 7/1984 | Gagne |
| 4,530,533 | A | 7/1985 | Dieter |
| 4,628,007 | A | 12/1986 | Ledsham |
| 4,643,380 | A | 2/1987 | Copeland |
| 4,659,045 | A | 4/1987 | Flynn |
| 4,669,689 | A | 6/1987 | Jones |
| 4,697,771 | A | 10/1987 | Majors |
| 4,749,011 | A | 6/1988 | Rylander |
| 4,760,982 | A | 8/1988 | Cooke |
| 4,884,603 | A | 12/1989 | Simpson |
| 4,890,652 | A | 1/1990 | Hoerner |
| 4,940,200 | A | 7/1990 | Sawyer |
| 4,955,496 | A | 9/1990 | Nelson |
| 4,979,547 | A | 12/1990 | Hoerner |
| 5,018,637 | A | 5/1991 | Miller |
| 5,048,778 | A | 9/1991 | Wright |
| 5,054,724 | A | 10/1991 | Hutcheson |
| 5,056,679 | A | 10/1991 | Lonczak |
| 5,065,965 | A | 11/1991 | Aulabaugh |
| 5,080,308 | A | 1/1992 | Franks |
| 5,090,756 | A | 2/1992 | Pfisterer |
| 5,129,609 | A | 7/1992 | Tobin |
| 5,271,589 | A | 12/1993 | Belous |
| 5,285,988 | A | 2/1994 | Bogren |
| 5,292,093 | A | 3/1994 | Shumake |
| 5,316,060 | A | 5/1994 | Hogdon et al. |
| 5,372,269 | A | 12/1994 | Sutton et al. |
| 5,400,989 | A | 3/1995 | Gaskill |
| D361,185 | S | 8/1995 | Seiler et al. |
| 5,593,117 | A | 1/1997 | Alexander |
| 5,610,230 | A | 3/1997 | Yoshida et al. |
| 5,716,033 | A | 2/1998 | Gibson |
| 5,765,614 | A | 6/1998 | Kardosh |
| 5,816,431 | A | 10/1998 | Giannopoulos |
| 5,868,364 | A | 2/1999 | MacMillan |
| 5,871,037 | A | 2/1999 | Feldt |
| 5,897,084 | A | 4/1999 | Judge |
| 5,915,768 | A | 6/1999 | Young |
| 5,918,651 | A | 7/1999 | Gazdy et al. |
| 5,979,842 | A | 11/1999 | Fan |
| 6,007,030 | A | 12/1999 | Judge |
| 6,035,908 | A | 3/2000 | Hoffman |
| 6,073,943 | A | 6/2000 | Serrault |
| 6,085,647 | A | 7/2000 | Burow |
| 6,116,548 | A | 9/2000 | Oleson |
| 6,116,549 | A | 9/2000 | Santa Cruz et al. |
| 6,131,759 | A | 10/2000 | Young |
| 6,135,518 | A | 10/2000 | Holthaus |
| 6,189,841 | B1 | 2/2001 | LaPoint et al. |
| 6,202,718 | B1 | 3/2001 | Innocenti |
| 6,273,156 | B1 | 8/2001 | Carillo |
| 6,296,212 | B1 | 10/2001 | Monahan |
| 6,340,037 | B1 | 1/2002 | Stafford |
| 6,367,747 | B1 | 4/2002 | Mulle |
| 6,415,713 | B1 | 7/2002 | Abrams |
| 6,431,435 | B1 | 8/2002 | Jones et al. |
| 6,450,461 | B1 | 9/2002 | Lohmann |
| 6,481,617 | B2 * | 11/2002 | Yang ..... 229/103 |
| 6,536,488 | B1 | 3/2003 | Pochobradsky |
| 6,554,810 | B1 | 4/2003 | Wilk et al. |
| 6,659,407 | B2 | 12/2003 | Asaro |
| 6,708,742 | B2 | 3/2004 | Weathers et al. |
| D500,457 | S | 1/2005 | Peeples et al. |
| D502,582 | S | 3/2005 | Boles |
| 6,860,094 | B1 | 3/2005 | Abrams |
| 6,866,070 | B2 | 3/2005 | King |
| 6,896,015 | B2 | 5/2005 | Beveridge |
| D513,352 | S | 12/2005 | Weathers et al. |
| 6,983,965 | B1 | 1/2006 | Bergell |
| 7,066,220 | B1 | 6/2006 | Take et al. |
| 7,066,379 | B2 | 6/2006 | McLeod et al. |
| 7,152,894 | B2 | 12/2006 | Weathers et al. |
| 7,246,641 | B2 | 7/2007 | Blessman |
| 7,302,978 | B1 | 12/2007 | Kolarik |
| D567,464 | S | 4/2008 | Dullum |
| 7,367,600 | B1 | 5/2008 | Lew et al. |
| 7,398,913 | B2 | 7/2008 | McClure |
| 7,407,139 | B1 | 8/2008 | Dolan |
| 7,494,096 | B2 | 2/2009 | Paloian et al. |
| D593,721 | S | 6/2009 | Koll |
| 7,651,024 | B2 | 1/2010 | Barner |
| 7,694,838 | B2 | 4/2010 | Yang |
| 7,712,623 | B2 | 5/2010 | Wentz et al. |
| 7,736,057 | B2 | 6/2010 | VanBost |
| 7,810,766 | B2 | 10/2010 | Blessman |
| 7,815,153 | B2 | 10/2010 | Campbell et al. |
| D633,268 | S | 2/2011 | Bottita |
| D639,519 | S | 6/2011 | Gomez |
| 8,757,563 | B2 | 6/2014 | Muse |
| 8,840,072 | B2 | 9/2014 | Muse |
| 8,978,964 | B1 | 3/2015 | Ruggiere, Sr. |
| 2002/0074247 | A1 | 6/2002 | Tremblay |
| 2002/0130224 | A1 | 9/2002 | Asaro |
| 2003/0173471 | A1 | 9/2003 | Weathers et al. |
| 2003/0218104 | A1 | 11/2003 | Klotz |
| 2006/0011785 | A1 | 1/2006 | McLean |
| 2006/0032991 | A1 | 2/2006 | Gaines |
| 2006/0144467 | A1 | 7/2006 | Butzer |
| 2008/0128479 | A1 | 6/2008 | Bates et al. |
| 2010/0108826 | A1 | 5/2010 | Fernandez et al. |
| 2010/0142860 | A1 | 6/2010 | Mincozzi |
| 2010/0237202 | A1 | 9/2010 | Mincozzi |
| 2010/0243650 | A1 | 9/2010 | Manley |
| 2010/0276247 | A1 | 11/2010 | Babineau et al. |
| 2011/0309209 | A1 | 12/2011 | Muse |

OTHER PUBLICATIONS

Muse, John Richard; Applicant-Initiated Interview Summary for U.S. Appl. No. 13/551,575, filed Jul. 17, 2012, mailed Dec. 19, 2014, 3 pgs.

Muse, John Richard; Notice of Allowance for U.S. Appl. No. 13/551,575, filed Jul. 17, 2012, mailed Feb. 2, 2015, 12 pgs.

Muse, John Richard; Final Office Action for U.S. Appl. No. 13/551,583, filed Jul. 17, 2012, mailed Dec. 31, 2014, 16 pgs.

Muse, John Richard; Applicant Initiated Interview Summary for U.S. Appl. No. 13/164,464, filed Jun. 20, 2011, mailed Mar. 11, 2014, 5 pgs.

Muse, John Richard; Final Office Action for U.S. Appl. No. 13/164,464, filed Jun. 20, 2011, mailed Jan. 10, 2014, 8 pgs.

Muse, John Richard; Final Office Action for U.S. Appl. No. 13/164,464, filed Jun. 20, 2011, mailed Sep. 23, 2013, 8 pgs.

Muse, John Richard; Final Office Action for U.S. Appl. No. 13/164,464, filed Jun. 20, 2011; mailed Feb. 22, 2013, 6 pgs.

Muse, John Richard; Non-Final Office Action for U.S. Appl. No. 13/164,464, filed Jun. 20, 2011, mailed May 29, 2013, 12 pgs.

Muse, John Richard; Non-Final Office Action for U.S. Appl. No. 13/164,464, filed Jun. 20, 2011; mailed Nov. 16, 2012, 17 pgs.

Muse, John Richard; Notice of Allowance for U.S. Appl. No. 13/164,464, filed Jun. 20, 2011, mailed Apr. 29, 2014, 11 pgs.

Muse, John Richard; Restriction Requirement for U.S. Appl. No. 13/164,464, filed Jun. 20, 2011, mailed Oct. 19, 2012; 6 pgs.

(56) References Cited

OTHER PUBLICATIONS

Muse, John Richard; U.S. Patent Application Entitled: Bag Stand, having U.S. Appl. No. 13/164,464, filed Jun. 20, 2011; 19 pgs.
Muse, John Richard; U.S. Continuation Application entitled: Bag Stand, having U.S. Appl. No. 14/447,043, filed Jul. 30, 2014, 19 pgs.
Muse, John Richard; Applicant Initiated Interview Summary for U.S. Appl. No. 13/164,473, filed Jun. 20, 2011, mailed Dec. 2, 2013, 3 pgs.
Muse, John Richard; Final Office Action for U.S. Appl. No. 13/164,473, filed Jun. 20, 2011, mailed Dec. 13, 2013, 28 pgs.
Muse, John Richard; Issue Notification for U.S. Appl. No. 13/164,473, filed Jun. 20, 2011, mailed Jun. 4, 2014, 1 pg.
Muse, John Richard; Notice of Allowance for U.S. Appl. No. 13/164,473, filed Jun. 20, 2011, mailed Mar. 13, 2014, 12 pgs.
Muse, John Richard; Supplemental Notice of Allowability for U.S. Appl. No. 13/164,473, filed Jun. 20, 2011, mailed May 27, 2014, 6 pgs.
Muse, John Richard; Final Office Action for U.S. Appl. No. 13/164,473, filed Jun. 20, 2011, mailed Mar. 13, 2013, 16 pgs.
Muse, John Richard; Non-Final Office Action for U.S. Appl. No. 13/164,473, filed Jun. 20, 2011, mailed Dec. 3, 2012; 19 pgs.
Muse, John Richard; Non-Final Office Action for U.S. Appl. No. 13/164,473, filed Jun. 20, 2011, mailed Jun. 25, 2013, 14 pgs.
Muse, John Richard; U.S. Patent Application Entitled: Funnel and Stand for Bag under U.S. Appl. No. 13/164,473, filed Jun. 20, 2011; 27 pgs.
Muse, John Richard; Final Office Action for U.S. Appl. No. 13/164,481, filed Jun. 20, 2011, mailed Apr. 5, 2013, 17 pgs.
Muse, John Richard; Non-Final Office Action for U.S. Appl. No. 13/164,481, filed Jun. 20, 2011, mailed Dec. 5, 2012; 18 pgs.
Muse, John Richard; Notice of Allowance for U.S. Appl. No. 13/164,481, filed Jun. 20, 2011, mailed Oct. 23, 2013, 11 pgs.
Muse, John Richard; Non-Final Office Action for U.S. Appl. No. 13/164,481, filed Jun. 20, 2011, mailed Jul. 11, 2013, 11 pgs.
Muse, John Richard; U.S. Patent Application Entitled: Bag Support under U.S. Appl. No. 13/164,481, filed Jun. 20, 2011; 21 pgs.
Muse, John Richard; Non-Final Office Action for U.S. Appl. No. 13/551,575, filed Jul. 17, 2012, mailed Dec. 6, 2013, 45 pgs.
Muse, John Richard; Non-Final Office Action for U.S. Appl. No. 13/551,575, filed Jul. 17, 2012, mailed May 16, 2014, 12 pgs.
Muse, John Richard; U.S. Patent Application Entitled: Bag Stand under U.S. Appl. No. 13/551,575, filed Jul. 17, 2012, 19 pgs.
Muse, John Richard; Non-Final Office Action for U.S. Appl. No. 13/551,583, filed Jul. 17, 2012, mailed Jul. 15, 2014, 38 pgs.
Muse, John Richard; U.S. Patent Application Entitled: Funnel and Stand for Bag under U.S. Appl. No. 13/551,583, filed Jul. 17, 2012, 16 pgs.
Muse, John Richard; U.S. Provisional Application entitled: Lawn Refuse Bag Holder having U.S. Appl. No. 61/357,526, filed Jun. 22, 2010; 10 pgs.
Muse, John Richard; U.S. Provisional Application Entitled: Funnel and Support Stand for a Lawn Refuse Bag having U.S. Appl. No. 61/357,516, filed Jun. 22, 2010, 15 pgs.
Muse, John Richard; U.S. Provisional Application Entitled: Insert for Gathering Lawn Refuse into a Bag having U.S. Appl. No. 61/357,518, filed Jun. 22, 2010, 16 pgs.
Muse, John Richard; U.S. Provisional Application Entitled: Bag Stand having U.S. Appl. No. 61/508,914, filed Jul. 18, 2011, 16 pgs.
Muse, John Richard; U.S. Provisional Application Entitled: Funnel and Stand for Bag having U.S. Appl. No. 61/508,934, filed Jul. 18, 2011, 12 pgs.
Muse, John Richard; Issue Notification for U.S. Appl. No. 13/164,464, filed Jun. 20, 2011, mailed Sep. 3, 2014, 1 pg.
Muse, John Richard; Final Office Action for U.S. Appl. No. 13/551,575, filed Jul. 17, 2012, Mailed Sep. 30, 2014, 22 pgs.
Muse, John Richard; Non-Final Office Action for U.S. Appl. No. 14/447,043, filed Jul. 30, 2014, mailed Mar. 31, 2015, 32 pgs.
Muse, John Richard; Issue Notification for U.S. Appl. No. 13/551,575, filed Jul. 17, 2012, mailed May 27, 2015, 1 pg.
Muse, John Richard; Non-Final Office Action for U.S. Appl. No. 14/701,022, filed Apr. 30, 2015, mailed Jun. 3, 2015, 12 pgs.
Muse, John Richard; U.S. Continuation Application entitled: Bag Stand having U.S. Appl. No. 14/701,022, filed Apr. 30, 2015, 22 pgs.
Muse, John Richard; Non-Final Office Action for U.S. Appl. No. 13/551,583, filed Jul. 17, 2012, mailed Apr. 1, 2015, 12 pgs.

* cited by examiner

BAG STAND

CROSS-REFERENCE TO RELATED APPLICATIONS

This application is a divisional of U.S. application Ser. No. 13/164,464, filed Jun. 20, 2011, which claims priority to U.S. Provisional Application No. 61/357,526 filed on Jun. 22, 2010, both of which are hereby specifically incorporated by reference herein in their entireties.

FIELD

The present disclosure relates to refuse disposal. More specifically, this disclosure relates to apparatus for facilitating holding open and filling a refuse bag.

BACKGROUND

To be discarded, refuse is typically bagged. However, refuse bags tend to be non-rigid and quite flexible. Particularly with lawn refuse, filling a refuse bag may become difficult when the refuse itself is non-solid or requires two hands to place into the bag. For example, leaves, needles, dirt, and sticks tend not to hold together when a user attempts to place such items in a bag. When attempting to place such items in the refuse bag, the refuse bag is subject to collapsing.

SUMMARY

A bag stand is disclosed for supporting and holding open a refuse bag to facilitate filling the refuse bag. The bag support is oriented to allow the bag support and refuse bag together to stand vertically with respect to the ground and allow a user to fill the refuse bag without the need to hold the refuse bag open manually.

DESCRIPTION OF THE FIGURES

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Disclosed is a bag stand to assist holding and filling refuse bags. It should be emphasized that the embodiments described herein are merely possible examples of implementations, merely set forth for a clear understanding of the principles of the present disclosure. Many variations and modifications may be made to the described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

One should note that conditional language, such as, among others, "can," "could," "might," or "may," unless specifically stated otherwise, or otherwise understood within the context as used, is generally intended to convey that certain embodiments include, while alternative embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment. Unless stated otherwise, it should not be assumed that multiple features, embodiments, solutions, or elements address the same or related problems or needs.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

Figure 1:
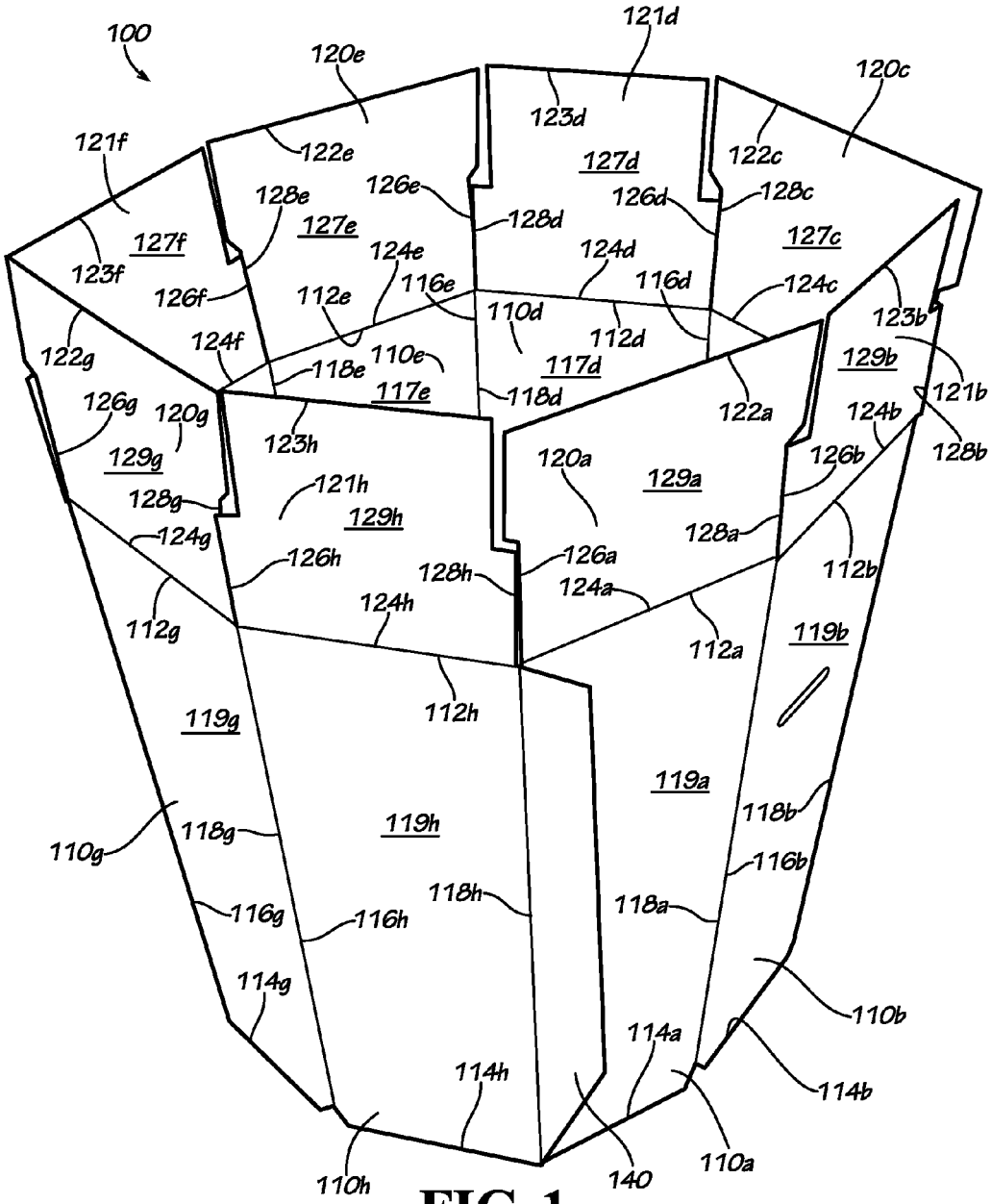
FIG. 1 is a perspective view of a bag stand for use with a refuse bag wherein male panel tabs and female panel tabs are shown extending above the top end of the bag stand.

FIG. 1 displays a bag stand 100 having a plurality of side panels 110(*a,b,c,d,e,f,g,h*) connected to each other and arranged along the outside of the bag stand 100 to form a hollow structure for holding a refuse bag.

The current embodiment of the bag stand 100 includes eight side panels 110*a,b,c,d,e,f,g,h*. Any number of side panels 110 may be used in alternative embodiments so long as the side panels 110 are formable into the bag stand 100 from a flattened position, as will be discussed further. In the current embodiment, all side panels 110*a,b,c,d,e,f,g,h* are dimensioned about the same size and are about rectangular in shape. However, in alternative embodiments, the side panels 110 may be of different sizes or shapes from each other and from the current embodiment.

Each of the side panels 110 has a top end 112, a bottom end 114, a left end 116, and a right end 118. The side panels 110 are connected to each other having the left end 116 of one side panel 110 connected to the right end 118 of an adjacent side panel 110.

All references to "left" and "right" in this disclosure are intended to refer to the left and right directions when viewed from the outside with the top end up and the bottom end down. All connections to which this disclosure refers may be any connection sufficient to hold together the elements to be connected, including an integrated construction, glue, a notched end, or other types of connecting means.

Connected to the top end 112 of each side panel 110 is one of a female panel tab 120 or a male panel tab 121. Although panel tabs 120,121 are connected to each side panel 110 in the current embodiment, the panel tabs 120,121 need not be included on every side panel 110. Moreover, the panel tabs need not be female panel tabs 120 or male panel tabs 121 in all embodiments, and the specific arrangement of female panel tabs 120 and male panel tabs 121 may change from one embodiment to another.

Each of the panel tabs 120,121 has a bottom end 124, a left end 126, and a right end 128. The bottom ends 124 of the panel tabs 120,121 are connected to the top ends 112 of the side panels 110. Although the panel tabs 120,121 are connected to the side panels 110, they are not connected to other panel tabs 120,121. This connection allows each panel tab 120,121 to hinge with respect to the side panel 110 to which it is connected. Female panel tabs 120 have top ends 122. Male panel tabs 121 have top ends 123.

Attached to the right end 118*h* of side panel 110*h* is a connection panel 140. The connection panel 140 overlaps the side panel 110*a* and provides an interface for the side panels 110*a* and 110*h* to form a connected hollow structure. In the current embodiment, the connection panel 140 is glued to side panel 110*a*. All other connections are integrated in the current embodiment. Side panels 110*a* and 110*h* are connected so that the left end 116*a* of side panel 110*a* is collinear with the right end 118*h* of side panel 110*h*. Although the two side panels 110*a* and 110*h* are connected through connection panel 140, they are still "connected" as described in this disclosure. The left end 116*a* and right end 118*h* need not be collinear in order to be considered connected within this disclosure.

Figure 2:
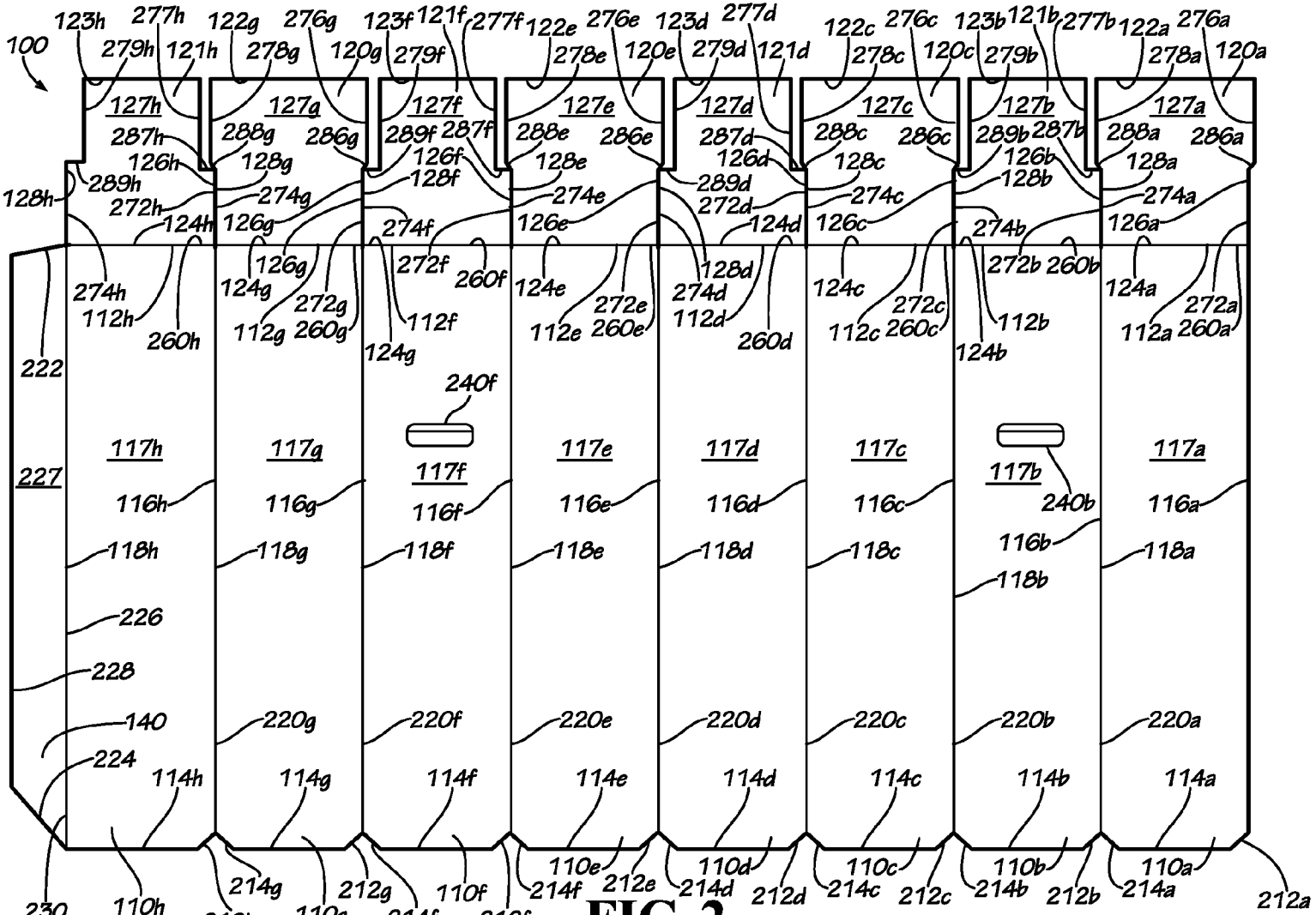
FIG. 2 is a schematic view of the inside of a blank formable into the bag stand of FIG. 1.

FIG. 2 displays an inside view of the bag stand 100 in a blank arrangement. The bag stand 100 is formable from a single cardboard blank. Each side panel 110*a,b,c,d,e,f,g* has two draft cutouts at its bottom end 114*a,b,c,d,e,f,g*—a left side draft 212*a,b,c,d,e,f,g* and a right side draft 214*a,b,c,d,e,f,g*. Side panel 110*h* has only a left side draft, 212*h*. The left side drafts 212 and right side drafts 214 in the current embodiment are about forty-five degree (45°) with respect to the bottom ends 124, the left ends 126, and the right ends 128 of the side panels 110, although other angular configurations are considered within this embodiment. Moreover, other shapes besides linear drafts are considered to be included as well. When assembled, the drafts 212,214 provide an escape for air passing from the inside to the outside of the bag stand 100.

At the intersection of each side panel 110 with an adjacent side panel 110 is a bend line. Bend lines to which this disclosure refers are designated as weakened regions and may include a crease, a perforation, a series of perforations, or another arrangement to weaken the area of the bend line to promote bending along the bend line. In the current embodiment, bend lines are creased to provide a hinged connection. Between right end 118*a* and left end 116*b* is bend line 220*a*; between right end 118*b* and left end 116*c* is bend line 220*b*; between right end 118*c* and left end 116*d* is bend line 220*c*; between right end 118*d* and left end 116*e* is bend line 220*d*; between right end 118*e* and left end 116*f* is bend line 220*e*; between right end 118*f* and left end 116*g* is bend line 220*f*; between right end 118*g* and left end 116*h* is bend line 220*g*.

The connection panel 140 has a top end 222, a bottom end 224, a left end 226, and a right end 228. The top end 222 of the connection panel 140 is formed at a downward angle with respect to the top ends 112*a,b,c,d,e,f,g,h* of the side panels 110*a,b,c,d,e,f,g,h*. Similarly, the bottom end 224 is formed with an upward angle with respect to the bottom ends 114,*a,b,c,d,e,f,g,h* of the side panels 110*a,b,c,d,e,f,g,h*. The angles of the top end 222 and the bottom end 224 create a shorter right side 228 than left side 226 of the connection panel 140. At the connection of the left end 226 of the connection panel 140 to the right end 118*h* of the side panel 110*h* is a bend line 230.

At the intersection of each side panel 110 with each panel tab 120,121 is a bend line 260. Each bend line 260*a,b,c,d,e,f,g,h* is located between each top end 112*a,b,c,d,e,f,g,h* of each side panel 110*a,b,c,d,e,f,g,h* and each bottom end 124*a,b,c,d,e,f,g,h* of each panel tab 120*a,c,e,g*;121*b,d,f,h*. The panel tabs 120*a,c,e,g* and 121*b,d,f,h* are connected only by the bend lines 260*a,b,c,d,e,f,g,h* and otherwise are not connected in the current embodiment, although other configurations are possible and considered within this disclosure. The single connection line of each panel tab 120*a,c,e,g* and 121*b,d,f,h* allows each panel tab 120*a,c,e,g* and 121*b,d,f,h* to be bent along its bend line 260*a,b,c,d,e,f,g,h*.

Located on side panels 110*b* and 110*f* proximate the top ends 112*b* and 112*f* are handle cutouts 240*b* and 240*f*, respectively. The handle cutouts 240*b,f* are generally ovular cutouts of material from the side panels 110*b,f* sized to accommodate the hands of a user. The handle cutouts 240*b,f* may be supplied as holes on the side panels 110*b,f*. In another embodiment, the handle cutouts 240*b,f* may be punchout regions supplied with weakened perforations to allow a user to punch through and remove material thereby forming a hole or cutout.

In alternative embodiments, the handle cutouts 240*b* and 240*f* may be in different places on the bag stand. For example, in some embodiments, the handle cutouts 240*b* and 240*f* may be placed closer to the top ends 112*b* and 112*f*; in some embodiments, the location of the handle cutouts 240*b* and 240*f* will necessitate corresponding cutouts in the panel tabs 121*b* and 121*f*. Moreover, in alternative embodiments, the handle cutouts 240*b* and 240*f* may be placed on other side panels 110*a,b,c,d,e,f,g,h*.

For each panel tab 120*a,c,e,g* and 121*b,d,f,h*, the width distance between each of the left end 126*a,b,c,d,e,f,g,h* and right end 128*a,b,c,d,e,f,g,h* of the panel tabs 120*a,c,e,g* and 121*b,d,f,h* is the same width as the side panel 110*a,b,c,d,e,f,g,h* to which each panel tab 120*a,c,e,g* and 121*b,d,f,h* is connected proximate the bottom end 124*a,b,c,d,e,f,g,h* of each panel tab 120*a,c,e,g* and 121*b,d,f,h*.

For the female panel tabs 120*a,c,e,g*, each left end 126*a,c,e,g* has a standard portion 272*a,c,e,g*, a flaring portion 276*a,c,e,g*, and a draft portion 286*a,c,e,g*. Likewise, each right end 128*a,c,e,g* of each female panel tab 120*a,c,e,g* has a standard portion 274*a,c,e,g*, a flaring portion 278*a,c,e,g*, and a draft portion 288*a,c,e,g*. The flaring portions 276,278 of the female panel tabs 120 are connected to the draft portions 286,288 which are further connected to the standard portions 272,274, respectively. The draft portions 286,288 are angled with respect to the other portions of the left end 126 and right end 128. The connections create a wider length top end 122 than bottom end 124 for each female panel tab 120*a,c,e,g*.

For the male panel tabs 121*b,d,f,h*, each left end 126*b,d,f,h* has a standard portion 272*b,d,f,h*, a compressed portion 277*b,d,f,h*, and a lateral portion 287*b,d,f,h*. Likewise, each right end 128*b,d,f,h* has a standard portion 274*b,d,f,h*, a compressed portion 279*b,d,f,h*, and a lateral portion 289*b,d,f,h*. Each standard portion 272,274 is connected to each compressed portion 277,279 by each lateral portion 287,289, respectively. The lateral portions 287,289 are parallel to the top ends 123 and bottom ends 124 of the male panel tabs 121. The connections create a narrower length top end 123 than bottom end 124 for each male panel tab 121*b,d,f,h*. Both the left ends 126 and the right ends 128 of each male panel tab 121 and female panel tab 120 are interfacing ends in the current embodiment, although they need not be in alternative embodiments. The interfacing ends in the current embodiment allow the panel tabs 120,121 to connect together, keeping the bag stand 100 in an open arrangement.

In alternative embodiments, features of the panel tabs 120, 121 may be different or removed. For example, in one alternative embodiment, the left end 126*a* does not include draft portion 286*a* or flaring portion 276*a*. Likewise, in one alternative embodiment, right end 128*h* does not include lateral portion 289*h* or compressed portion 279*h*.

The bag stand 100 is formed by folding the side panels 110*a,b,c,d,e,f,g,h* and connection panel 140 by their bend lines 220*a,b,c,d,e,f,g* and 230 until the connection panel 140 contacts the side panel 110*a*. In the current embodiment, shown in FIG. 1, the connection panel 140 overlaps the side panel 110*a* so that an inner surface 227 of the connection panel 140 contacts an outer surface 119*a* of the side panel 110*a*. The connection panel 140 is affixed to the side panel 110*a* by gluing. Other configurations are contemplated within this disclosure, including the connection panel 140 overlapping an inner surface 117*a* of the side panel 110*a*, connections by connecting tabs or key fit arrangements between the panels, and integrated connection, among others. When the connection is established, the left end 116*a* of the side panel 110*a* is about aligned with the right end 118*h* of the side panel 110*h*, although it need not be aligned in every embodiment.

Figure 3:
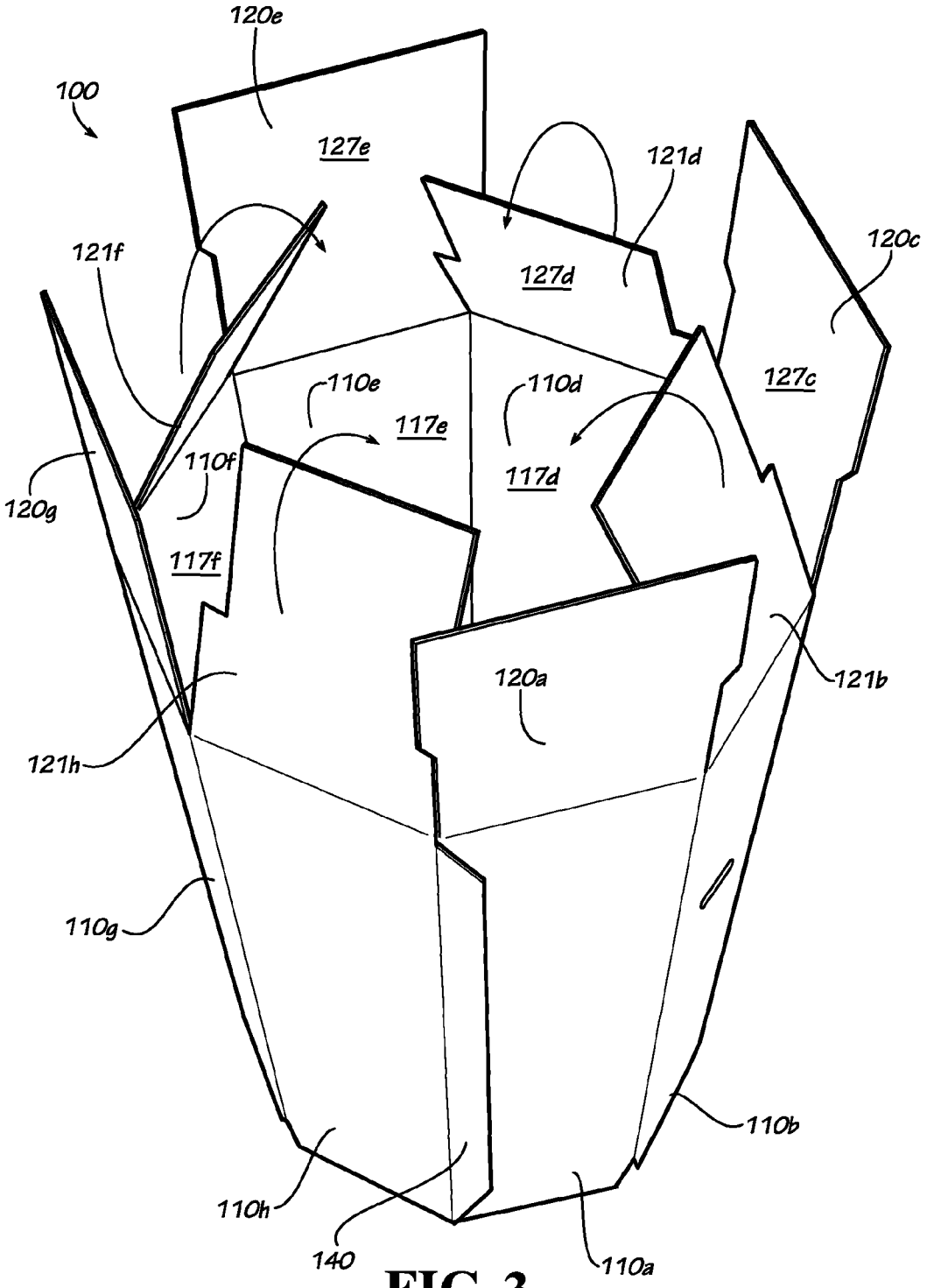
FIG. 3 is a perspective view of the bag stand of FIG. 1 showing the folding action of the male panel tabs.
Figure 4:
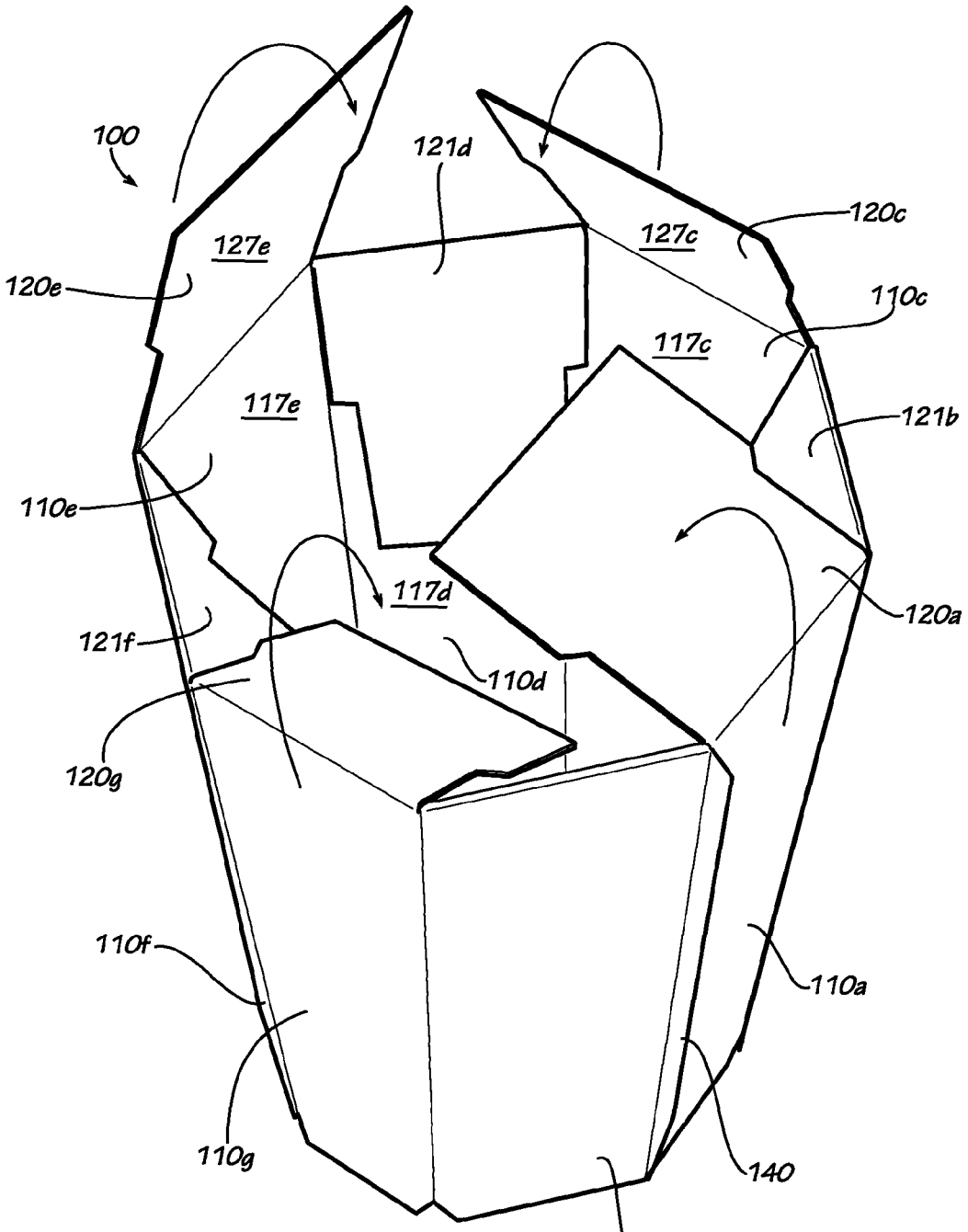
FIG. 4 is a perspective view of the bag stand of FIG. 1, wherein the male panel tabs have been folded, showing the folding action of the female panel tabs.
Figure 5:
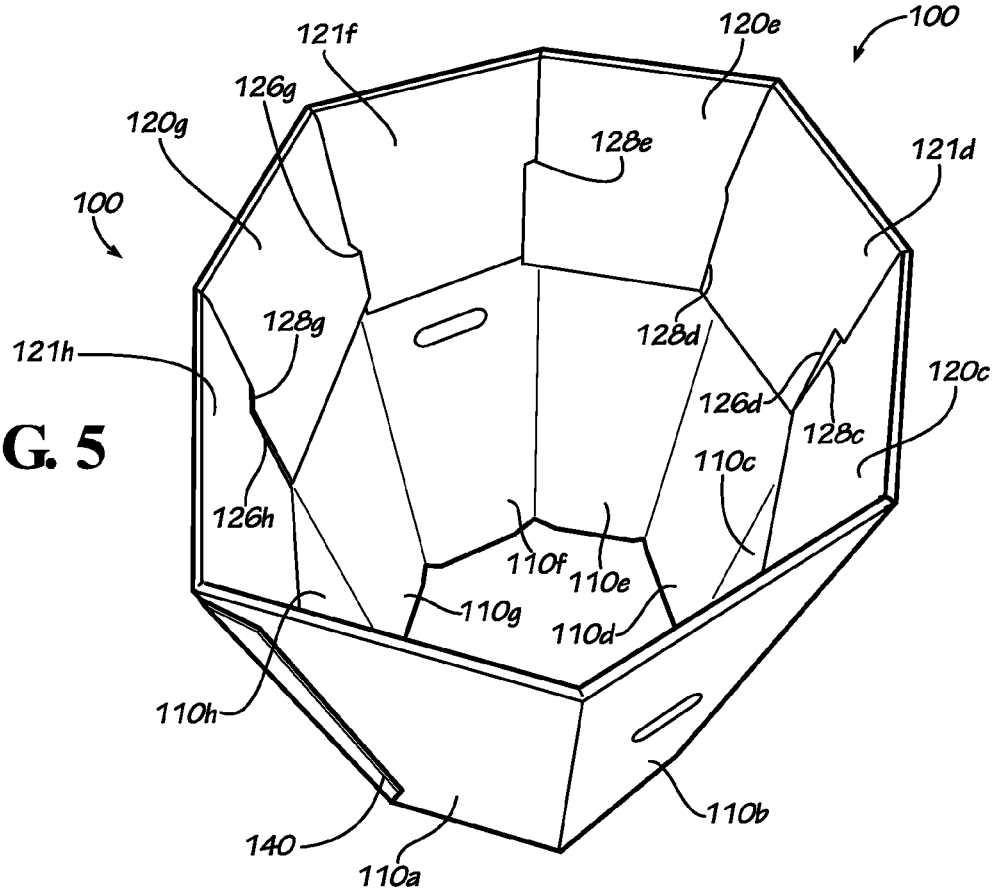
FIG. 5 is a perspective view of the bag stand of FIG. 1 in a final stand shape.

In the configuration of FIG. 1, the side panels 110 are all connected so that their top ends 112 together form a top end of the bag stand 100. The panel tabs 120,121 are shown raised from the top end of the bag stand 100. To form a completed bag stand, a user first folds the male panel tabs 121 in so that inner surfaces 127 of the male panel tabs 121 approach, and potentially contact, inner surfaces 117 of the side panels 110, as seen in FIG. 3. The user then folds the female panel tabs 120 so that the inner surfaces 127 of the female panel tabs 120 approach, and potentially contact, the inner surfaces 117 of the side panels 110, as seen in FIG. 4. For each male panel tab 121, the left ends 126 of the male panel tabs 121 interface with the right ends 128 of adjacent female panel tabs 120, and the right ends 128 of the male panel tabs 121 interface with the left ends 126 of adjacent female panel tabs 120. The flaring portions 276,278 of the female panel tabs 120 interface with the compressed portions 277,279 of the male panel tabs 121, forming a substantially interlocking interface, as seen in FIG. 5. Because the panel tabs 120,121 are substantially rigid, the substantially interlocking interface prevents collapse of the bag stand 100. Although a substantially interlocking interface is described, other arrangements sufficient to hold the bag stand 100 in an upright and uncollapsed position should be considered included within this disclosure.

Figure 6:
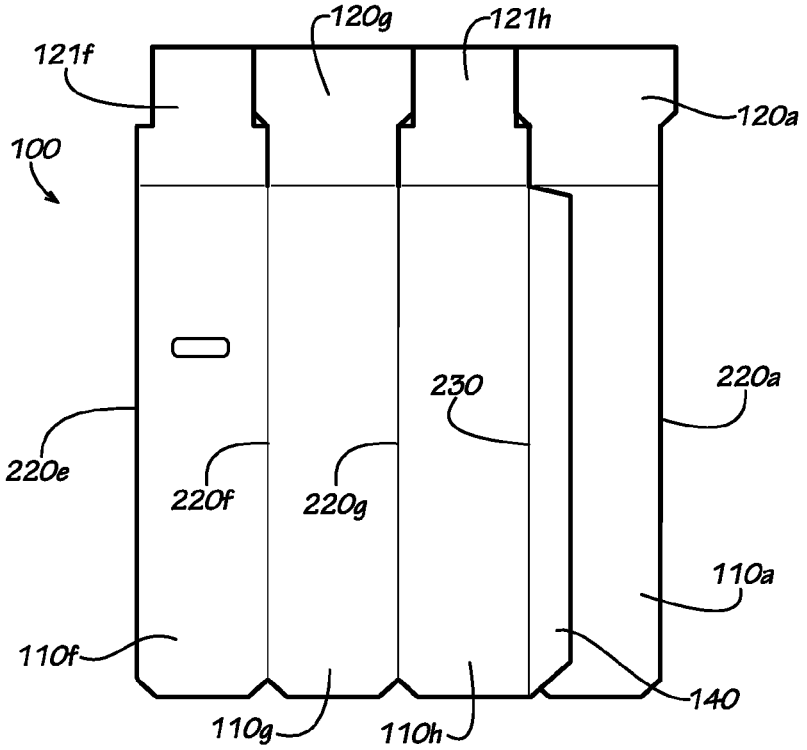
FIG. 6 is a side view of the bag stand of FIG. 1 in a flattened arrangement.
Figure 7:
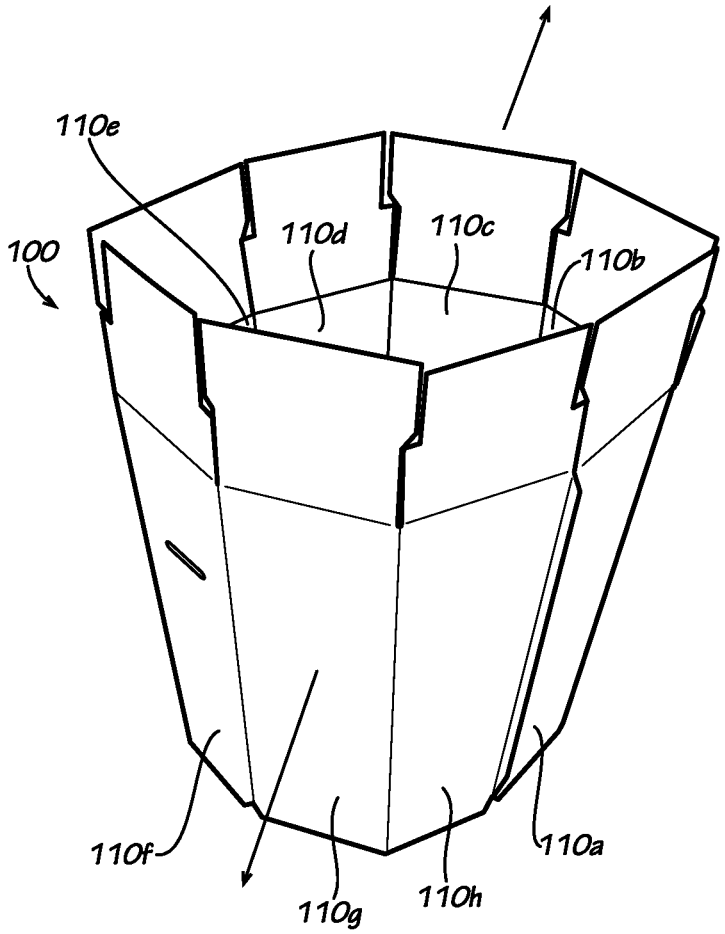
FIG. 7 is a perspective view of the bag stand of FIG. 6 while being unflattened.

As seen in FIG. 6, in some embodiments the bag stand 100 will be provided to the user in a flattened arrangement. The bag stand 100 is flattened by having bend lines 220*a* and 220*e* bent with all other bend lines unbent. The connection panel 140 is attached to the side panel 110*a*. In this arrangement, the bag stand 100 is easily shipped and is easily stored. Moreover, connection panel 140 is glued to side panel 110*a* such that a user of the bag stand 100 need only unbend somewhat along bend lines 220*a* and 220*e* while bending along bend lines 220*b,c,d,f,g* and 230 to form the bag stand 100 of FIG. 1. The unbending and bending process is shown in perspective view in FIG. 7. The user then need follow the steps described above and shown in FIGS. 3 and 4 to form the completed bag stand 100 of FIG. 5.

Figure 8:
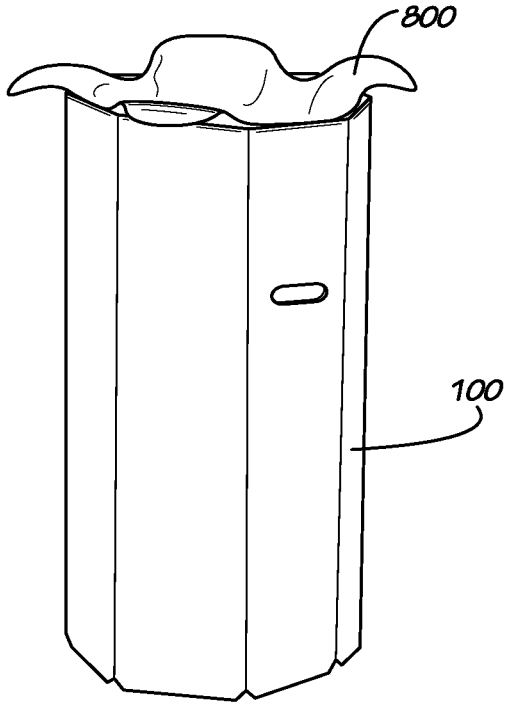
FIG. 8 is a perspective view of the bag stand of FIG. 5 with a refuse bag inserted inside.
Figure 9:
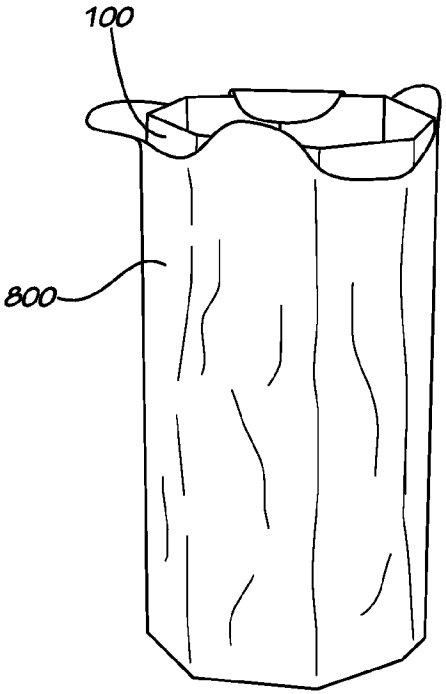
FIG. 9 is a perspective view of the bag stand of FIG. 5 with a refuse bag placed over the outside.

Once the bag stand 100 is configured in the arrangement of FIG. 5, a refuse bag 800 may be inserted into the bag stand 100, as seen in FIG. 8, or placed over the outside of the bag stand 100, as seen in FIG. 9. In the current embodiment, the refuse bag 800 is a plastic refuse bag, although other refuse bags may be implemented in alternative embodiments. The bag stand 100 is sized to accommodate a specific sized refuse bag 800, and other sizes of bag stands 100 may be used with other sizes of refuse bags 800.

Figure 10:
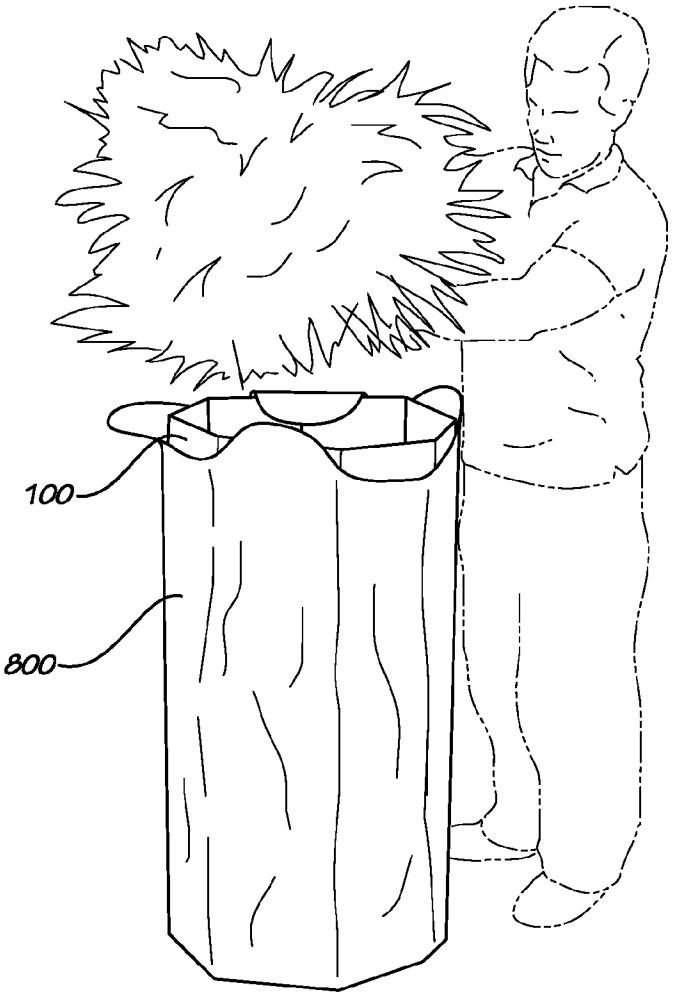
FIG. 10 is a perspective view of the bag stand of FIG. 9 in use.

Once the bag stand 100 and refuse bag 800 are configured together, a user may fill the refuse bag with refuse, as seen in FIG. 10. The refuse may include any type of refuse, including lawn refuse, trash, and biodegradable waste, among others. When the refuse bag 800 is appropriately filled with refuse, the user may discard the refuse bag 800, the refuse, and the bag stand 100 together. The user may optionally remove the bag stand 100 from the refuse bag 800, discarding the refuse bag 800 and refuse while retaining the bag stand 100 for later use. A user may also disassemble the bag stand 100, reversing the assembly steps shown in FIGS. 3-7 and described above with reference to those figures.

Where materials are chosen for the elements of this assembly—particularly, corrugated cardboard—similar generally rigid material choices may also be used and would be obvious to one in the art, including corrugated cardboard or paper, linerboard, polymer, plastic, metal, alloy, wood, mesh, laminate, reinforced woven or nonwoven fabric, cellulose, composite, and combinations or mixtures of the foregoing, among others.

What is claimed is:

1. A method of assembling a bag stand comprising the steps of:

receiving a blank formable into a bag stand having at least one side panel, each side panel having a top end, a bottom end, a left end, and a right end, at least one side panel connected to at least one adjacent side panel by a bend line, the blank also having a plurality of panel tabs, each panel tab connected to the top end of at least one side panel by at least one bend line, each panel tab having at least one interfacing end for connection to at least one other of the plurality of panel tabs, the blank also having at least one connection panel connected to at least one side panel by at least one bend line;

bending the blank along at least one bend line; and connecting the at least one connection panel to the blank by a feature of the connection panel that is not the bend line.

2. The method of claim 1, wherein the blank is made of corrugated cardboard.

3. The method of claim 1, wherein each panel tab is one of a male panel tab and a female panel tab.

4. The method of claim 1, wherein the blank includes at least one handle cutout.

5. The method of claim 1, wherein the blank includes an even number of side panels.

6. The method of claim 1, wherein the blank includes eight side panels.

7. The method of claim 1, wherein at least one side panel includes at least one left side draft.

8. The method of claim 1, wherein at least one side panel includes at least one right side draft.

9. A method of assembling a bag stand comprising the steps of:

receiving a bag stand having at least one side panel, each side panel having a top end, a bottom end, a left end, and a right end, the right end of each at least one side panel connected to the left end of at least one adjacent side panel, the bag stand also having a plurality of panel tabs, each panel tab hingedly connected to the top end of at least one side panel, each panel tab having at least one interfacing end for connection to at least one other of the plurality of panel tabs, the bag stand in a flattened arrangement;

unflattening the bag stand to a shape sufficient to hold open a refuse bag, the shape defining a cross-sectional shape of the bag stand; and arranging the plurality of panel tabs such that the at least one interfacing end of each panel tab interfaces with an interfacing end of at least one other of the plurality of panel tabs to form a top end of the bag stand.

10. The method of claim 9, wherein the bag stand is made of corrugated cardboard.

11. The method of claim 9, wherein each panel tab is one of a male panel tab and a female panel tab.

12. The method of claim 9, wherein at least one side panel includes at least one left side draft.

13. The method of claim 9, wherein at least one side panel includes at least one right side draft.

14. The method of claim 9 further comprising the step of:

bending the plurality of panel tops relative to the top end of the bag stand, the right end and left end of each panel tab interfacing with the adjacent panel tabs, such that the inner surface of each panel tab is positioned adjacent to and facing the inner surface of a corresponding one of the left side panel, right side panel, and the at least one intermediate side panel, thereby forming a substantially interlocking interface between each panel tab, the plurality of panel tabs thereby defining an opening at the top end of the bag stand.

15. The method of claim 9, wherein each side panel is connected to one panel tab.

16. The method of claim 9, wherein each panel tab is connected to one side panel.

17. A method of using a bag stand comprising the steps of:

receiving a bag stand having at least one side panel, each side panel having a top end, a bottom end, a left end, and a right end, the right end of each at least one side panel connected to the left end of at least one adjacent side panel, the bag stand having a top end and a bottom end, the bag stand also having a plurality of panel tabs, each panel tab hingedly connected to the top end of at least one side panel, each panel tab having at least one interfacing end for connection to at least one other of the plurality of panel tabs;

orienting the bag stand in a sufficient shape to hold open a refuse bag, wherein the top end of the bag stand defines an opening and wherein the bag stand defines a cavity therein in communication with the opening;

standing the bag stand by placing the bottom end of the bag stand downward;

receiving a refuse bag having a top end and a bag portion, the bag portion being substantially continuous and having an inner surface and an outer surface, the top end defining an opening;

coupling the top end of the refuse bag with the top end of the bag stand;

supporting the bag portion of the refuse bag by one of inserting the bag portion of the refuse bag into the opening of the bag stand to occupy at least a portion of the cavity; and inserting the bag stand through the opening of the refuse bag and into the bag portion of the refuse bag; and inserting refuse into the opening of the refuse bag.

18. The method of claim 17 further comprising the steps of: removing the refuse bag and refuse from the bag stand; and disposing of the refuse bag and refuse.

19. The method of claim 17 further comprising the steps of: disposing of the refuse bag, refuse, and bag stand.

20. The method of claim 17, wherein each panel tab is one of a male panel tab and a female panel tab.

* * * * *